US011003127B2

(12) United States Patent
Yuasa

(10) Patent No.: US 11,003,127 B2
(45) Date of Patent: May 11, 2021

(54) DEVELOPER COLLECTING CONTAINER

(71) Applicant: CANON KABUSHIKI KAISHA, Tokyo (JP)

(72) Inventor: Masato Yuasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/166,480

(22) Filed: Oct. 22, 2018

(65) Prior Publication Data

US 2019/0056690 A1 Feb. 21, 2019

Related U.S. Application Data

(63) Continuation of application No. PCT/JP2017/017611, filed on Apr. 28, 2017.

(30) Foreign Application Priority Data

Apr. 28, 2016 (JP) ..... JP2016-091378

(51) Int. Cl.
*G03G 21/12* (2006.01)
*G03G 21/16* (2006.01)
(Continued)

(52) U.S. Cl.
CPC ..... *G03G 21/12* (2013.01); *G03G 15/0856* (2013.01); *G03G 21/105* (2013.01); *G03G 21/16* (2013.01)

(58) Field of Classification Search
CPC ..... G03G 21/12; G03G 21/105; G03G 21/10; G03G 15/0875; G03G 15/0894; G03G 15/0844
(Continued)

(56) References Cited

U.S. PATENT DOCUMENTS

2009/0074434 A1* 3/2009 Ishii ..... G03G 21/12 399/35
2012/0163837 A1* 6/2012 Tomita ..... G03G 15/00 399/13
(Continued)

FOREIGN PATENT DOCUMENTS

JP H04-119385 A 4/1992
JP 2014-016525 A 1/2014
JP 2015-102586 A 6/2015

OTHER PUBLICATIONS

International Search Report and Written Opinion for International Patent Application No. PCT/JP2017/017611, dated Jun. 13, 2017.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

A developer collecting container 1, mountable to and dismountable from an accommodating portion 10 provided in an apparatus, for collecting a collected matter which is powder or a fluid collected in the apparatus has a constitution in which a bonding portion 5 partially bonding opposing sides of sides forming an accommodating portion 3 for accommodating the collected matter is provided and in which at least a part of the bonding portion 5 is positioned below a height at which a volume of the accommodating portion 3 is half of a target collecting volume in a case that the volume is measured upwardly from a lowermost portion with respect to a direction of gravitation.

11 Claims, 8 Drawing Sheets

(51) Int. Cl.
*G03G 15/08* (2006.01)
*G03G 21/10* (2006.01)

(58) Field of Classification Search
USPC ..... 399/360
See application file for complete search history.

(56) References Cited

U.S. PATENT DOCUMENTS

| | | | | |
|---|---|---|---|---|
| 2013/0164063 | A1* | 6/2013 | Konishi | G03G 21/105 399/358 |
| 2014/0016977 | A1 | 1/2014 | Kakitani et al. | |
| 2014/0312067 | A1* | 10/2014 | Loomis | A47G 19/12 222/143 |
| 2015/0331356 | A1 | 11/2015 | Kakitani | |

OTHER PUBLICATIONS

May 26, 2020 Office Action in Japanese Patent Application No. 2016-091378.
Aug. 3, 2020 Office Action in Chinese Patent Application No. 201780025982.1 (with English translation).

* cited by examiner

DEVELOPER COLLECTING CONTAINER

TECHNICAL FIELD

The present invention relates to a developer collecting container for collecting powder or a fluid collected in an apparatus such as an image forming apparatus, of an electrophotographic type.

BACKGROUND ART

In the image forming apparatus of the electrophotographic type, such as a copying machine or a printer, toner remaining on a photosensitive member after a toner image is transferred from the photosensitive member onto a recording material is removed and collected by a cleaning device. Further, in an image forming apparatus using a two-component developer, in order to suppress a lowering in charging performance of the two-component developer, the two-component developer in a certain proportion is steadily taken out and collected from a developing device in some instances. Further, in an image forming apparatus of an intermediary transfer type, toner remaining on an intermediary transfer member after a toner image is transferred from the intermediary transfer member onto a recording material is removed and collected by a cleaning device.

In such an image forming apparatus, in order to simplify a constitution and to facilitate an exchanging operation, a collecting container common to a plurality of cleaning devices or developing devices is provided, and a collected matter such as a collected toner or a collected two-component developer is collected together. The collecting container is constituted so as to be mountable to and dismountable from an apparatus main assembly, and when the collecting container is filled with the collected matter, the collecting container is exchanged with a blank collecting container in general.

Further, in recent years, image quality improvement and speed-up of the image forming apparatus advance, particularly enlargement of POD market, such as a copy shop or print industry, in which a copy volume is large and advances, so that a demand for a large volume (capacity) of the collecting container increases for the purpose of lowering a frequency of the exchanging operation.

Japanese Laid-Open Patent Application 2014-16525, a collecting container configured to be mountable to and dismountable from an apparatus main assembly and to be exchanged when an amount of a collected toner detected by a sensor mounted to the apparatus main assembly reaches a predetermined amount is disclosed.

Problem to be Solved by the Invention

However, with an increase in volume of the collecting container, deformation of the collecting container due to pressure of the collected matter filled in the collecting container was liable to occur. Further, when the collecting container is deformed, a mounting and demounting operation of the collecting container relative to the apparatus main assembly is impaired in some instances. Further, in the case of a constitution in which the collected matter in the collecting container is detected by the sensor provided in the apparatus main assembly, positional accuracy between the sensor and a detecting portion in the collecting container becomes important, and therefore, when the collecting container is deformed, detection accuracy lowers in some instances.

Incidentally, in order to suppress the deformation of the collecting container, it would be considered that a high-strength material is used as a material constituting the collecting container, but it leads to an increase in cost.

Accordingly, an object of the present invention is to provide a developer collecting container which is a simple and which is capable of suppressing deformation even in the case where a volume of the developer collecting container is increased.

Means for Solving the Problem

According to an aspect of the present invention, there is provided a collecting container, which is mountable to and dismountable from an accommodating portion provided in an apparatus, for collecting a collected matter being powder or a fluid collected in the apparatus, in which a bonding portion partially bonding opposing sides, to each other, of sides forming the accommodating portion for accommodating the collected matter is included, and at least a part of the bonding portion is positioned below a height at which a volume of the accommodating portion is half of a target collecting volume in the case where the height is measured from a lowermost portion of the accommodating portion toward above with respect to a direction of gravitation.

According to another aspect of the present invention, there is provided a collecting container, which is mountable to and dismountable from an accommodating portion provided in an apparatus, for collecting a collected matter being powder or a fluid collected in the apparatus, in which a detecting portion for detecting the collected matter collected in the collecting container and a bonding portion partially bonding opposing sides together of sides forming the accommodating portion for accommodating the collected matter are included, and the bonding portion is positioned below the detecting portion.

Effect of the Invention

According to this embodiment, even in the case where the collecting container is increased in volume, deformation of the collecting container can be suppressed by a constitution which is simple and advantageous in suppressing in an increase of a cost.

EMBODIMENTS FOR CARRYING OUT THE INVENTION

In the following, a collecting container according to the present invention will be further specifically described in accordance with the drawings.

Embodiment 1

1. Image Forming Apparatus

Figure 1:
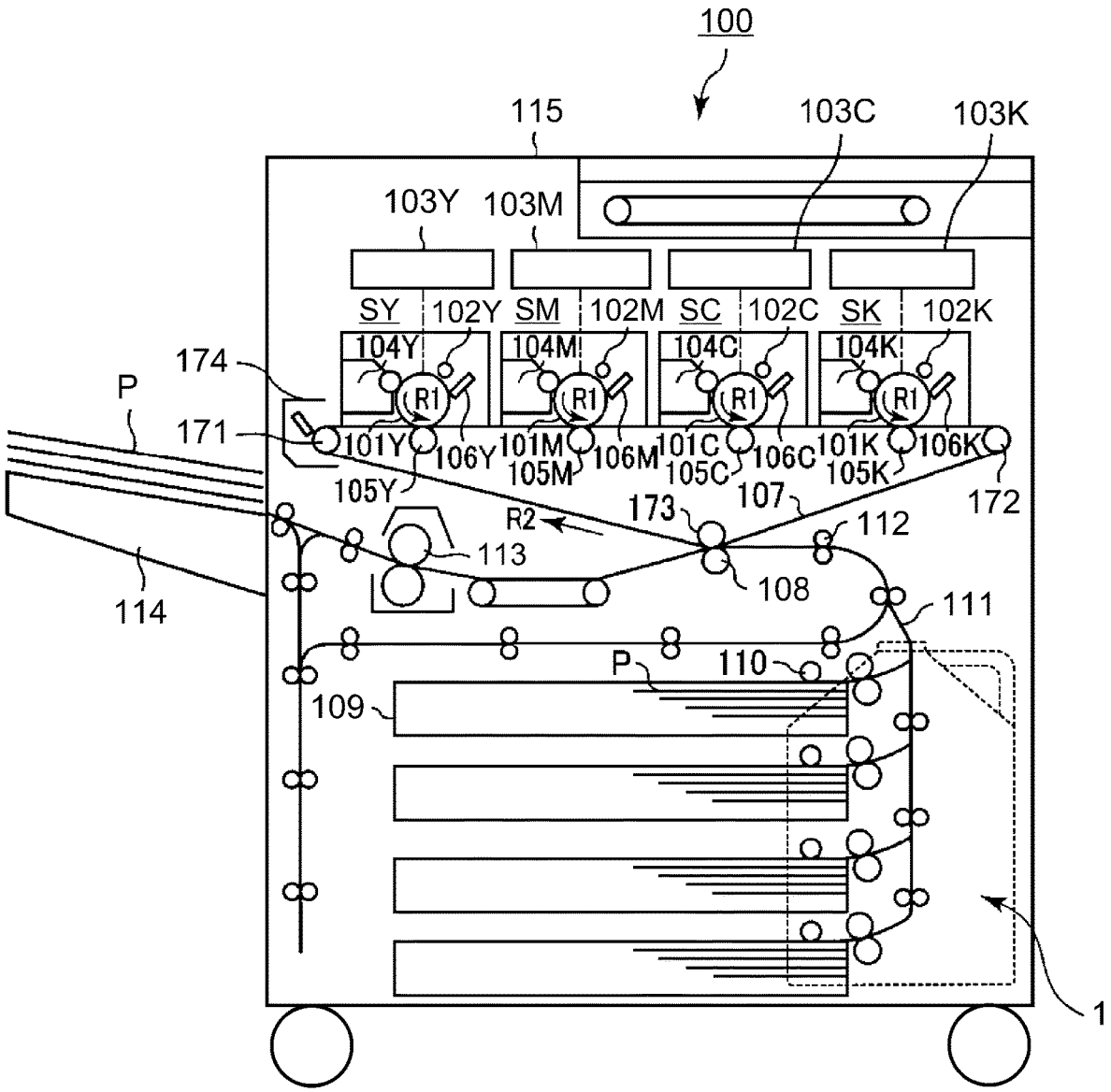
FIG. 1 is a schematic sectional view of an image forming apparatus.

FIG. 1 is a schematic sectional view of an image forming apparatus 100 of this embodiment. The image forming apparatus 100 of this embodiment is a tandem-type full-color image forming apparatus employing an intermediary transfer type.

The image forming apparatus 100 includes first, second, third and fourth image forming portions (stations) SY, SM, SC and SK for forming toner images of respective colors of yellow, magenta, cyan and black, respectively. In these four image forming portions SY, SM, SC and SK, as regards elements having the same or corresponding functions or constitutions, suffixes Y, M, C and K representing elements for associated colors are omitted and collectively described in some instances. In this embodiment, the image forming portion S is constituted by including a photosensitive member 101, a charging roller 102, an exposure device 103, a developing device 104, a primary transfer roller 105, and a photosensitive member cleaning device 106 which are described later.

A drum-type photosensitive member (photosensitive drum) 101 as an image bearing member is rotationally driven in an arrow R1 direction in the figure. A surface of the rotating photosensitive member 101 is electrically charged by the charging roller 102 as a charging means. The charged surface of the photosensitive member 101 is subjected to scanning exposure depending on image information by the exposure device (laser scanner) 103, so that an electrostatic latent image (electrostatic image) is formed on the photosensitive member 101. The electrostatic latent image formed on the photosensitive member 101 is developed (visualized) with a developer by the developing device 104, so that a toner image is formed on the photosensitive member 101. In this embodiment, the developing device 104 uses, as a developer, a two-component developer in which toner (non-magnetic toner) and a carrier (magnetic carrier) are mixed with each other. Incidentally, in this embodiment, the two-component developer with a certain proportion is steadily discharged from the developing device 104, so that a lowering in charging performance of the developer in the developing device 104 is suppressed.

An intermediary transfer belt 107 as an intermediary transfer member is provided so as to oppose the four photosensitive members 101. The intermediary transfer belt 107 is stretched by a driving roller 171, a tension roller 172 and a secondary transfer opposite roller 173. On an inner peripheral surface side of the intermediary transfer belt 107, the primary transfer rollers 105 as primary transfer means are disposed correspondingly to the respective photosensitive members 101. The toner image formed on the photosensitive member 101 as described above is electrostatically transferred (primary-transferred) onto the intermediary transfer belt 107, rotating in an arrow R2 direction in the figure in contact with the photosensitive member 101, by the primary transfer roller 105 to which a primary transfer bias is applied. For example, during full-color image formation, the toner images of the respective colors of yellow, magenta, cyan and black formed on the respective photosensitive members 101 are successively transferred superposedly onto the intermediary transfer belt 107.

On an outer peripheral surface side of the intermediary transfer belt 107, at a position opposing the secondary transfer opposite roller 173, a secondary transfer roller 108 as a secondary transfer means is provided. As described above, the toner image formed on the intermediary transfer belt 107 is electrostatically transferred (secondary-transferred), by the secondary transfer roller 108 to which a secondary transfer bias is applied, onto a recording material P such as paper fed by being nipped between the intermediary transfer belt 107 and the secondary transfer roller 108. The recording material P is accommodated in a cassette 109 and is fed to a feeding path 111 by a feeding roller 110. Thereafter, this recording material P is timed to the toner image on the intermediary transfer belt 107 by a registration roller 112 and is fed to a contact portion between the secondary transfer roller 108 and the intermediary transfer belt 107.

The recording material P on which the toner image is transferred is fed to a heat fixing device 113 as a fixing means, and the toner image is fixed (melt-fixed) on a surface thereof by being heated and pressed. Thereafter, the recording material P is sent to a discharge tray 114 provided at an outside portion of an apparatus main assembly 115 of the image forming apparatus 100.

On the other hand, the toner (transfer residual toner) remaining on the photosensitive member 101 after the primary transfer step is removed and collected from the photosensitive member 101 by the photosensitive cleaning device 106 as a photosensitive member cleaning means. The photosensitive member cleaning device 106 scrapes and removes the transfer residual toner from the rotating photosensitive member 101 by a cleaning blade disposed in contact with the photosensitive member 101. The toner (transfer residual toner) remaining on the intermediary transfer belt 107 after a secondary transfer step is removed and collected from the intermediary transfer belt 107 by a belt cleaning device 174 as an intermediary transfer member cleaning means. The belt cleaning device 174 is disposed at a position opposing the driving roller 171 on the outer peripheral surface side of the intermediary transfer belt 107. The belt cleaning device 174 scrapes and removes the transfer residual toner from the rotating intermediary transfer belt 107 by a cleaning blade disposed in contact with the intermediary transfer belt 107.

2. Collecting Path of Collected Matter

Figure 2:
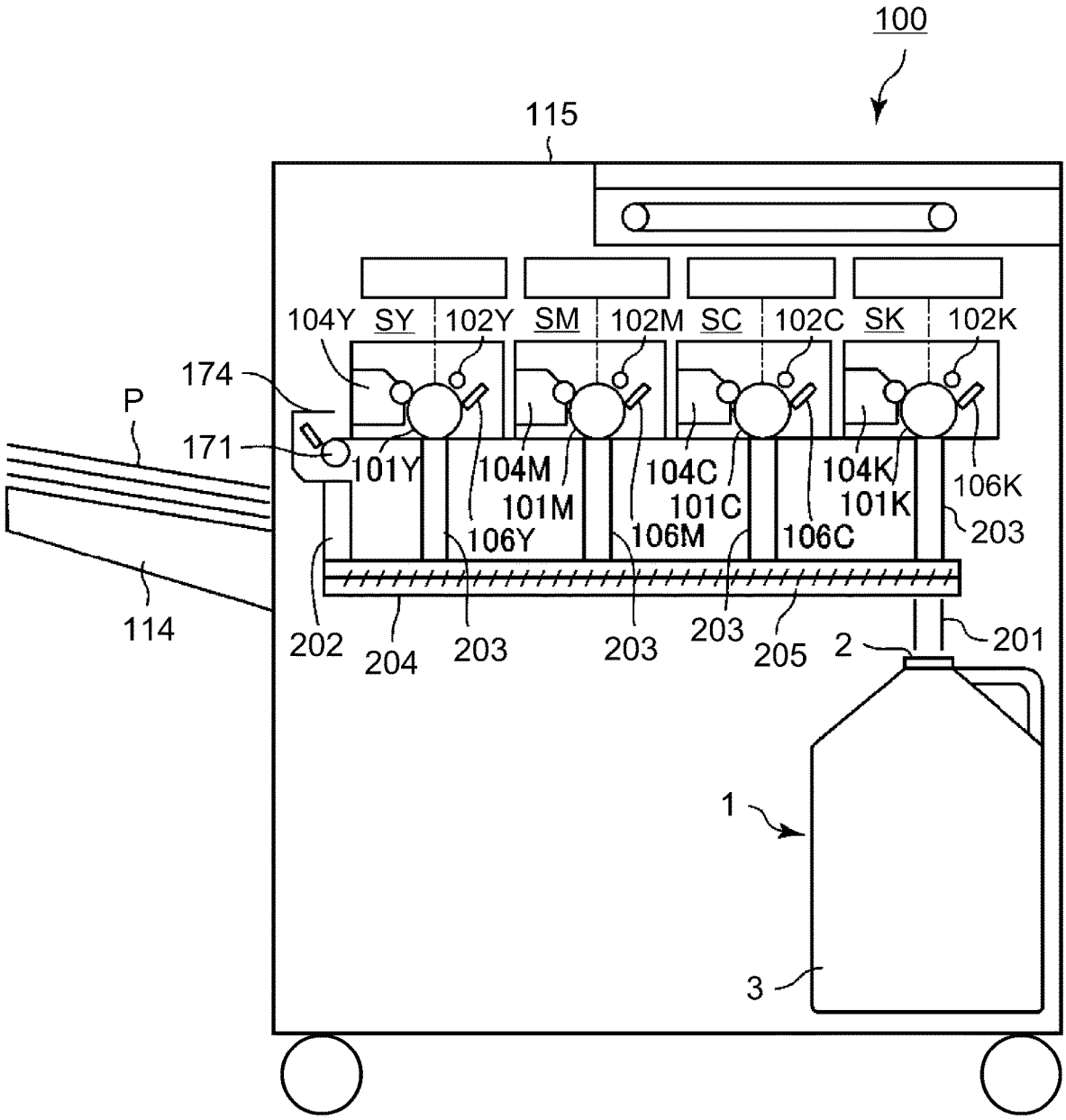
FIG. 2 is a schematic view, of the image forming apparatus, showing a feeding path of collected toner.

Next, a collecting path of the transfer residual toners generating during image formation and a deteriorated developer generating in the developing device 104 (hereinafter, collectively referred to as "collected toner") will be described. FIG. 2 is a schematic sectional view of the image forming apparatus 100 of this embodiment and omits a part of elements shown in FIG. 1 so as to make a collected toner collecting path easy to understand. Incidentally, as regards the image forming apparatus 100 and elements thereof, a front side of the drawing sheets of FIGS. 1 and 2 is a front side, and a rear side of the drawing sheets of FIGS. 1 and 2 is a rear side. Further, as regards the image forming apparatus 100 and the elements thereof, a left-right direction refers to a left-right direction in the case where the apparatus or the elements are seen from the front side. Further, as regards the image forming apparatus 100 and the elements thereof, an up-down direction refers to an up-down direction of a direction of gravitation (vertical direction) in an ordinary use (operation) state, but does not mean only immediately above and immediately below, and also includes an upper side and a lower side with respect to a horizontal plane passing through an objective position or element.

The collected toner collected by the photosensitive member cleaning device 106 of each of the image forming portions S is fed toward the rear surface side of the image forming apparatus 100 by a screw (not shown) as a feeding means and is fed to a first vertical pipe 203 as a feeding path. Similarly, the collected toner discharged from the developing device 104 of each of the image forming portions S is also fed to the first vertical pipe 203. Further, the collected toner collected by the belt cleaning device 174 is fed toward the rear surface side of the image forming apparatus 100 by a screw (not shown) as a feeding means and is fed to a second vertical pipe 202 as a feeding path.

The collected toner falling inside the first vertical pipe 203 by gravitation and the collected toner falling inside the second vertical pipe 202 by gravitation merge with each other inside a main pipe 204 as a feeding path. The toner in the main pipe 204 is fed to a discharging pipe 201 as a feeding path by a collecting screw 205 as a feeding means. Then, the collected toner 201 fed to the discharging pipe 201 falls inside the discharging pipe 201 by gravitation and is collected in a developer collecting container 1. The developer collecting container 1 includes, at an upper portion thereof a receiving opening 2 which is an opening for receiving the collected toner, and the collected toner falling inside the discharging pipe 201 falls through the receiving opening 2, and thus is deposited in an accommodating portion 3 in the developer collecting container 1.

3. Developer Collecting Container

Figure 3:
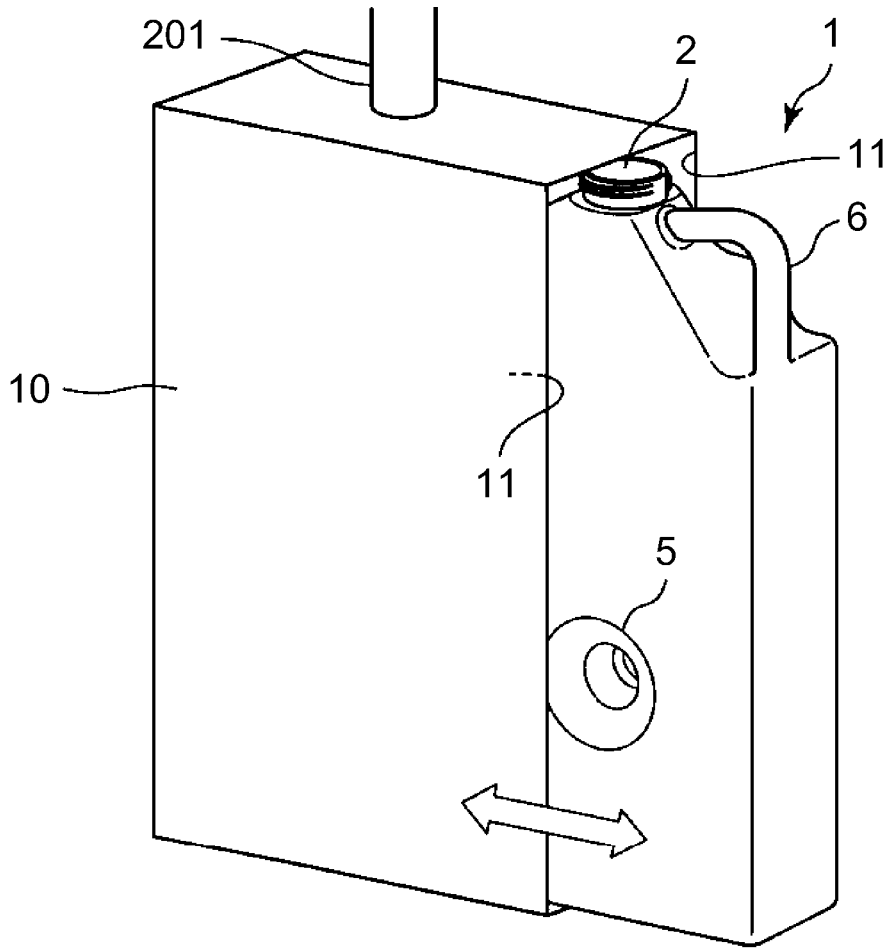
FIG. 3 is a perspective view of an accommodating portion and a collecting container in an embodiment.
Figure 4:
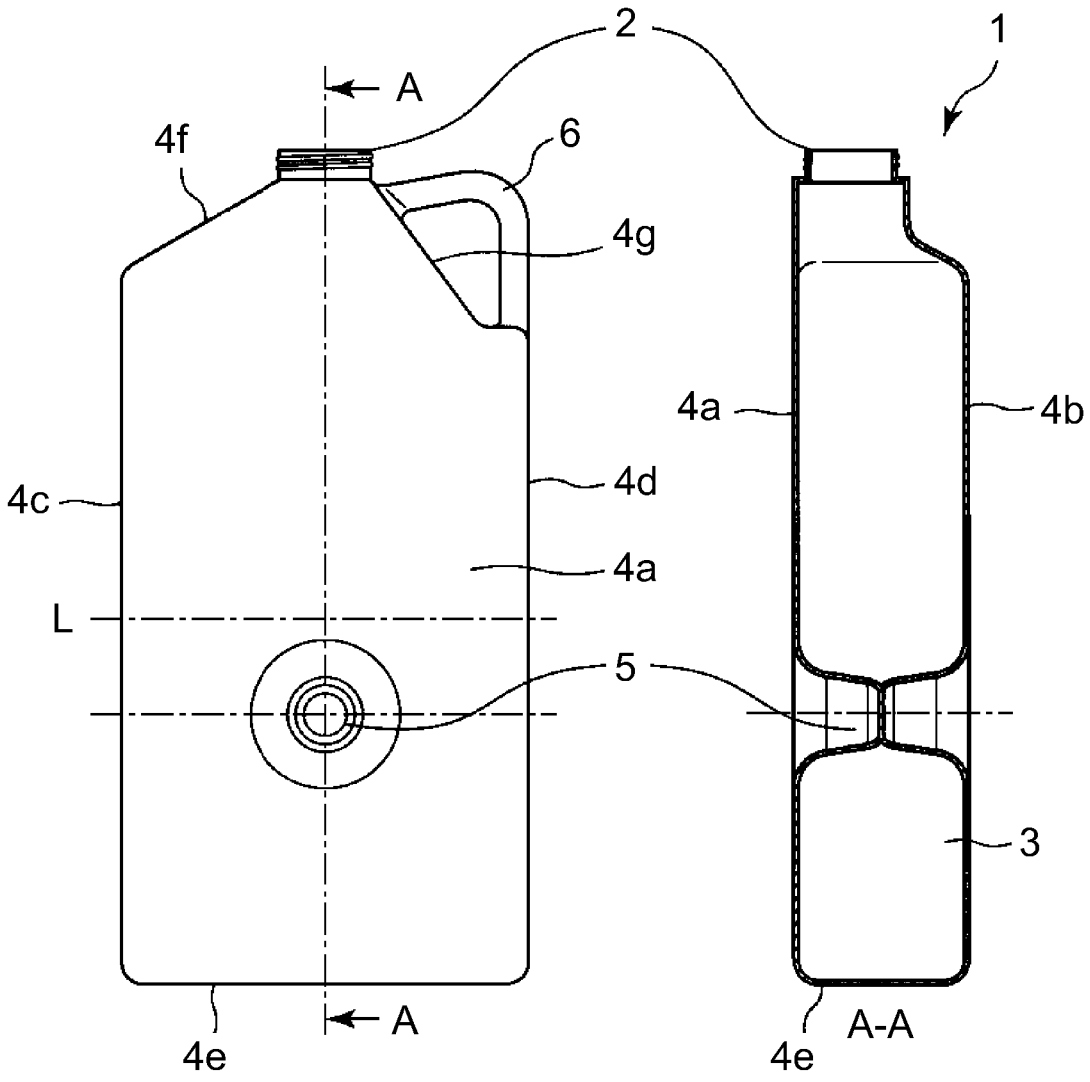
FIG. 4 is a front view and a perspective view of the collecting container in the embodiment.

Next, the developer collecting container 1 in this embodiment will be further described specifically. FIG. 3 is a perspective view showing an accommodating portion 10 described later and the developer collecting container 1 partially dismounted from the accommodating portion 10. FIG. 4 is a front view and a sectional view (A-A line cross-section in the front view).

The developer collecting container 1 is dismountably accommodated from the accommodating portion 10 provided in the apparatus main assembly 115. The developer collecting container 1 is provided on a rear surface side of the image forming apparatus 100. The developer collecting container 1 has a substantially box-like shape and is open at a right-side portion (opening), and mounting and discharging of the developer collecting container 1 are carried out through the opening.

The developer collecting container 1 includes, as a plural pair of opposing sides (surfaces), a front wall side (surface) (first side (surface)) 4*a* and a rear wall side (surface) (second side (surface)) 4*b* which are substantially parallel to each other and a left wall side (surface) (third side (surface)) 4*c* and a right wall side (surface) (fourth side (surface)) 4*d* which are substantially parallel to each other. Further, the developer collecting container 1 includes, at a lower portion, a bottom with which each of the front wall side 4*a*, the rear wall side 4*b*, the left wall side 4*c* and the right wall side 4*d* is connected. Further, the developer collecting container 1 includes upper wall sides (surfaces) 4*f* and 4*g* inclined from the left wall side 4*c* and the right wall side 4*d*, respectively, toward the above-described receiving opening 2 so as to project upwardly. The receiving opening 2 is provided by being positioned at an uppermost portion between these upper wall sides 4*f* and 4*g*. A space enclosed by these wall sides 4*a* to 4*g* is an accommodating portion 3 for accommodating the collected toner. In this embodiment, the developer collecting container 1 has a long shape with respect to the direction of gravitation. That is, each of the front wall side 4*a*, the rear wall side 4*b*, the left wall side 4*c* and the right flat side (surface) 4*d* is long in dimension with respect to the direction of gravitation. By this, it is possible to enhance a filling ratio of the collected toner in the developer collecting container 1 without using a leading means such as a screw.

Incidentally, in this embodiment, at a periphery of the receiving opening 2 which is circular opening portion, screw threads are formed, so that the receiving opening 2 can be closed by causing a cap (not shown) to be threadably engaged with the screw threads after the collecting container 2 is dismounted from the accommodating portion 10. Further, one (right-side) upper wall side 4*g* is provided with a grip portion 6 for being operated during an operation such as mounting and dismounting of the developer collecting container 1 relative to the accommodating portion 10 by an operator such as a user or a person in charge of service.

To an upper portion of the accommodating portion 10 provided in the apparatus main assembly 115, a discharging pipe 201 is fixed, so that the discharging pipe 201 and an inside of the accommodating portion 10 communicate with each other. When the developer collecting container 1 is accommodated in the accommodating portion 10, the receiving opening 2 of the developer collecting container 1 is disposed immediately under the discharging pipe 201. In order to decrease an error of a relative position between the discharging pipe 201 and the receiving opening 2, a gap between the developer collecting container 1 and the accommodating portion 10 is set at a necessary minimum value.

When the developer collecting container 1 is exchanged, the operator grips the grip portion 60 of the developer collecting container 1 and pulls out the developer collecting container 1 in a substantially horizontal direction. By this, the front wall side 4*a* and the rear wall side 4*b* slide with an inner side (surface) of the accommodating portion 10, so that the developer collecting container 1 is guided in the substantially horizontal direction.

Further, in this embodiment, the developer collecting container 1 includes a bonding portion 5 partially bonding together opposing sides (surfaces) of sides (surfaces) forming the accommodating portion 3 for accommodating the collected toner. Particularly, in this embodiment, the bonding portion 5 partially bonding the front wall side 4*a* and the rear wall side 4*b* together is provided. By this, deformation of the developer collecting container 1 when the collected toner is filled in the developer collecting container 1 is suppressed.

Here, the bonding portion 5 may preferably be provided at a portion (typically, a most deforming portion) liable to be deformed in a state in which the inside of the developer collecting container 1 becomes full of (fully filled with) the collected toner. Incidentally, this fully filled state is a state in which the collected toner in a maximum amount which is a target set for the developer collecting container 1 in advance. Further, a volume set for the accommodating portion 3 of the developer collecting container 1 in advance so that the accommodating portion 3 can accommodate the collected toner in the maximum amount is referred to as a "target collecting volume". In this embodiment, at least a part of the bonding portion 5 is positioned below a height L at which the volume of the accommodating portion 3 is half (½) of the target collecting volume in the case where the volume is measured from a lowermost portion of the accommodating portion 3 upwardly with respect to the direction of gravitation. In this embodiment, an entirety of the bonding portion 5 is positioned below the height L corresponding to half of the target collecting volume. Further, in this embodiment, the bonding portion 5 is provided so as to bond the front wall side 4*a* and the rear wall side 4*b* together which are a pair of sides (surfaces), having a broadest (largest) surface area, of a plurality of pairs of opposing sides forming the accommodating portion 3.

Thus, by bonding together the opposing sides which are liable to be expanded and deformed by pressure of the collected toner during full filling of the developer collecting container 1 and which have a broad area at the lower portion of the developer collecting container 1, so that deformation of the developer collecting container 1 during the full filling can be suppressed. Accordingly, it is possible to suppress an increase in sliding resistance when the developer collecting container 1 is mountable to and dismountable from the accommodating portion 10. Particularly in this embodiment, the sides bonded by the bonding portion 5 are sides sliding with the accommodating portion 10 when the developer collecting container 1 is mountable to and dismountable from the accommodating portion 10. Thus, by suppressing the deformation of the sides, by the bonding portion 5, which constitute a guide when the developer collecting container 1 is mountable to and dismountable from the accommodating portion 10.

Further, in this embodiment, as regards the bonding portion 5, a single bonding portion is provided at a substantially central portion of each of the front wall side 4*a* and the rear wall side 4*b* with respect to the horizontal direction. By this, the deformation of the front wall side 4*a* and the rear wall side 4*b* having a relatively broad area can be effectively suppressed by the bonding portions 5 small in number. However, the number of the bonding portions 5 is not limited to one but a plurality of bonding portions may also be provided (for each side).

Further, the accommodating portion 3 of the developer collecting container 1 may preferably be formed of an integral member. In this embodiment, as regards the developer collecting container 1, an entirely thereof is formed integrally by blow molding of plastic. Thus, at least the accommodating portion 3 of the developer collecting container 1 is formed by integral molding of plastic, so that cost reduction of the developer collecting container 1 can be realized. Accordingly, the developer collecting container 1 including the bonding portion 5 can be manufactured at a relatively low cost.

As described above, according to this embodiment, even in the case where the developer collecting container 1 is increased in volume, the deformation of the developer collecting container 1 can be suppressed by a constitution which is simple and advantageous in suppression of an increase in cost. By this, a lowering in operativity during mounting and dismounting of the developer collecting container 1 can be suppressed.

Embodiment 2

Next, another embodiment of the present invention will be described. Basic constitution and operation of an image forming apparatus in this embodiment are the same as those in Embodiment 1. Accordingly, in this embodiment, elements having identical or corresponding function or constitutions to these in Embodiment 1 are represented by the same reference numerals or symbols and will be omitted from detailed description.

Figure 5:
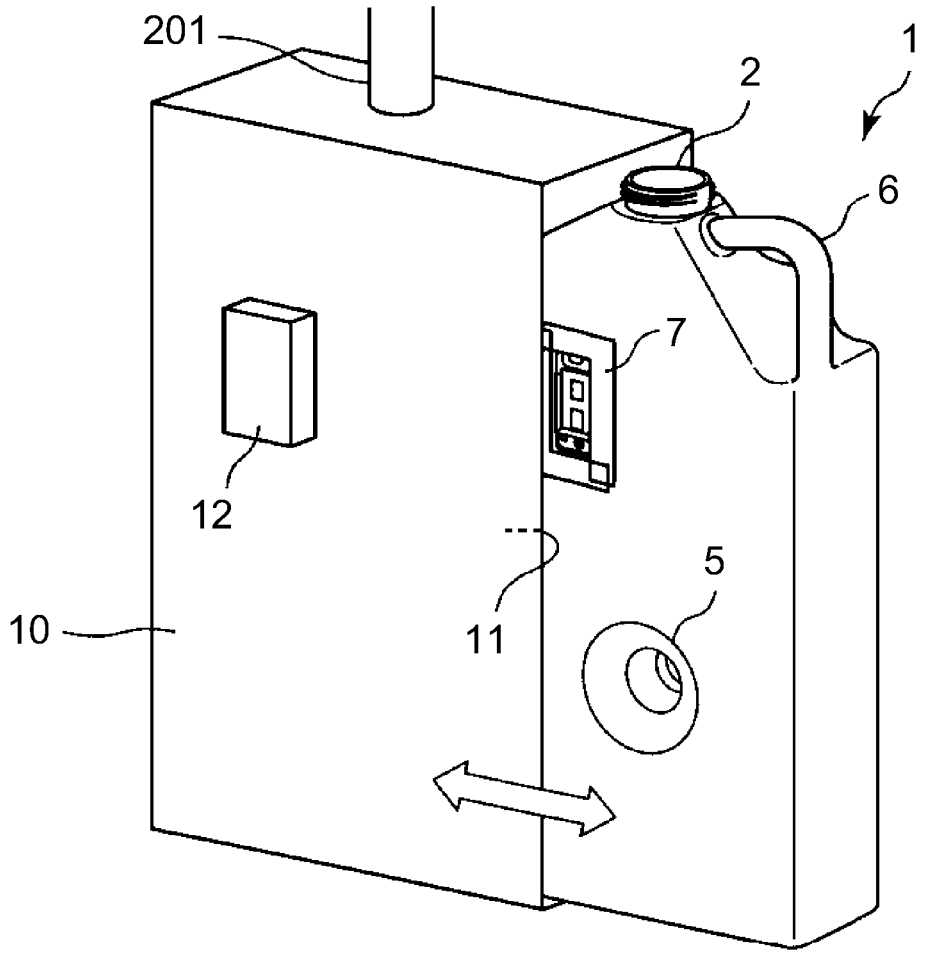
FIG. 5 is a perspective view of an accommodating portion and a collecting container in another embodiment.
Figure 6:
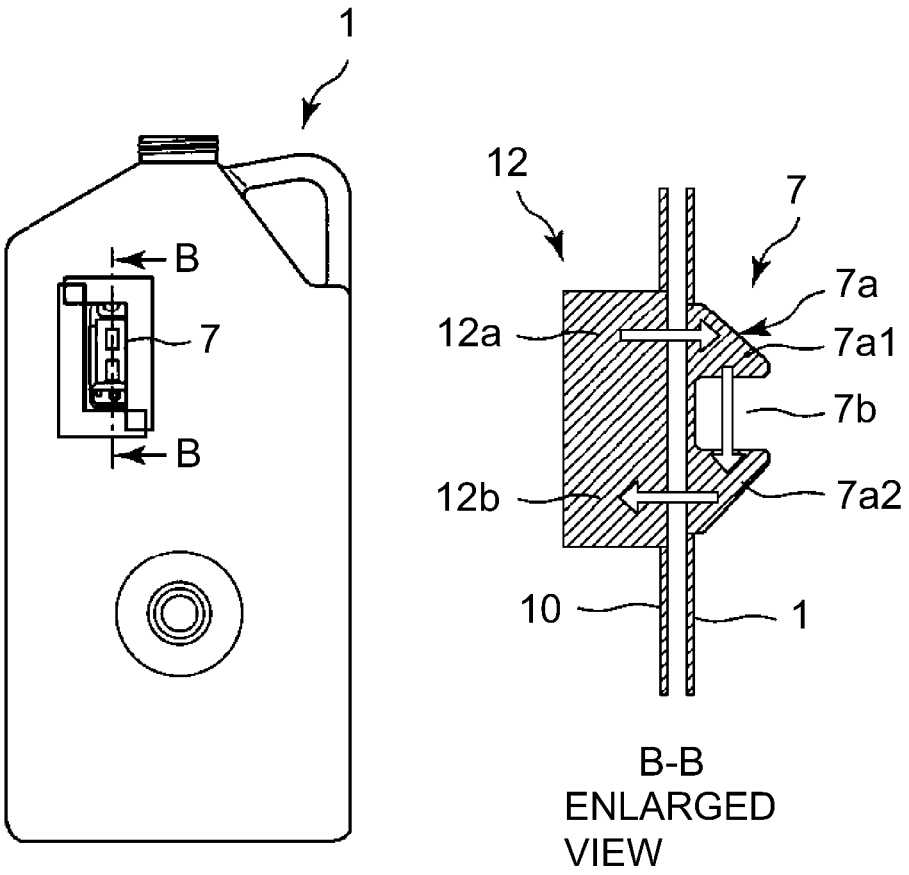
FIG. 6 is a front view and a partially sectional view of the collecting container in another embodiment.
Figure 7:
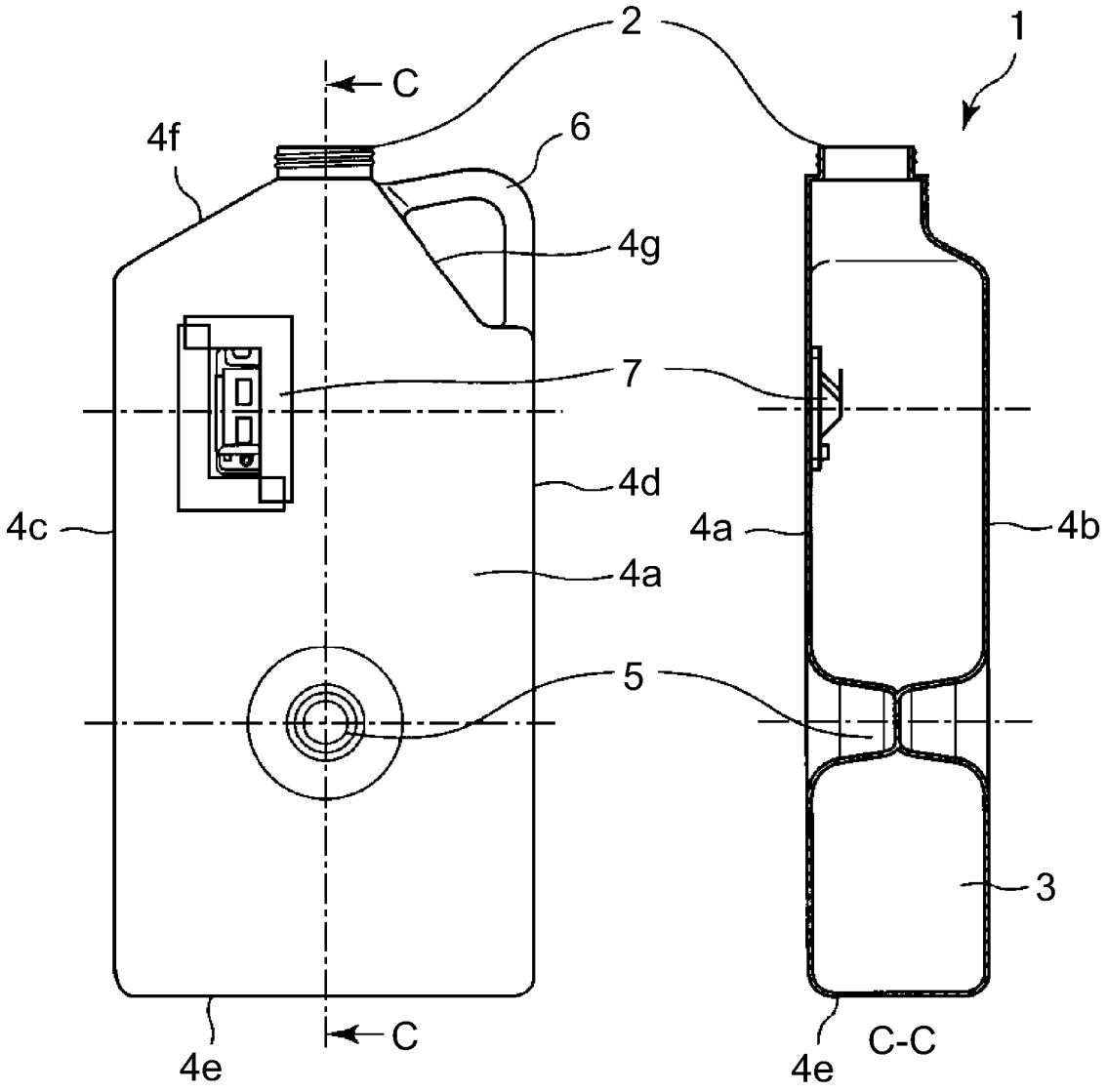
FIG. 7 is a front view and a sectional view of the collecting container in another embodiment.

FIG. 5 is a perspective view showing an accommodating portion 10 and developer collecting container 1 partially dismounted from the accommodating portion 10 in this embodiment. FIG. 6 is a front view and a partially sectional view (B-B line cross-section in the front view) of the developer collecting container 1 in this embodiment. FIG. 7 is front view and a partially sectional view (C-C line in cross-section in the front view) of the developer collecting container 1 in this embodiment.

In this embodiment, the developer collecting container 1 includes a detecting portion 7 for detecting the collected toner collected in the accommodating portion 3. In this embodiment, the detecting portion 7 is provided so as to detect that the collected toner is charged in the developer collecting container 1 in a predetermined amount by detecting a powder surface of the collected toner in the accommodating portion 3. Further, in this embodiment, the accommodating portion 10 provided in the apparatus main assembly 115 is provided with an optical sensor 12 as a detecting means for detecting that the collected toner in the developer collecting container 1 is charged to a position of the detecting portion 7. In this embodiment, the detecting portion 7 is provided on a front wall side 7*a* of the developer collecting container 1, and the sensor 12 is provided at a corresponding position of the accommodating portion 10.

As shown in FIG. 6, the sensor 12 is constituted by including a light-emitting portion 12*a* and a light-receiving portion 12*b*. Further, the detecting portion 7 is constituted by including a prism 7*a* provided so as to project toward the inside of the developer collecting container 1. The prism 7*a* includes a first prism portion 7*a*1 for changing a direction of light from the light-emitting portion 12*a* toward below substantially right angle and a second prism portion 7*a*2 for changing a direction of the light from the first prism portion 7*a*1 toward an outside substantially right angle. Further, in a gap between the first prism portion 7*a*1 and the second prism portion 7*a*2, a detecting region 7*b* where the collected toner can enter is formed. The light emitted from the light-emitting portion 12*a* passes through the prism 7*a* and is reflected by the prism portions toward the light-receiving portion 12*b* along an optical path of arrows shown in the figure. In the case where the collected toner in the developer collecting container 1 is not charged to a position of the detecting portion 7, i.e., in the case where the collected toner is not present in the detecting to region 7*b*, the light emitted from the light-emitting portion 12*a* always reaches the light-receiving portion 12*b*. On the other hand, at the time of full filling (charging) of the developer collecting container 1, the powder surface of the collected toner in the developer collecting container 1 reaches the position of the detecting portion 7, so that the collected toner enters the detecting region 7*b* on the optical path of the prism 7*a*. By this, the optical path is blocked, so that a fully filled state of the developer collecting container 1 is detected.

In the above-described optically detecting method, it is important that an optical path length is kept at a constant value in order to maintain detection accuracy, so that it is important that a clearance between the sensor 12 and the detecting portion 7 is maintained at a certain level. For that reason, in this embodiment, the gap between the developer collecting container 1 and the accommodating portion 10 is set at a necessary minimum level.

Further, in this embodiment, the bonding portion 5 bonding the front wall side 4*a* provided with the detecting portion 7 and the rear wall side 4*b* opposing the front wall side 4*a* together is provided. By this, deformation of the developer collecting container 1 when the collected toner is filled in the developer collecting container 1 is suppressed. That is, in this embodiment, the detecting portion 7 is provided on the side bonded by the bonding portion 5. By this, even in a state close to the fulling filled state of the developer collecting container 1, deformation of the side provided with the detecting portion 7 is suppressed and the clearance between the detecting portion 7 and the sensor 12 is maintained at a certain level, so that a lowering in detection accuracy can be suppressed.

Further, in this embodiment, the bonding portion 5 is positioned below the detecting portion 7 so as not to affect the powder surface of the collected toner in the state close to the fully filled state of the developer collecting container 1. Thus, by bonding together the opposing sides positioned below the detecting portion 7 for detecting the collected toner, it is possible to suppress the deformation of the developer collecting container 1 without having the influence on the detection of the collected toner. Incidentally, the detecting portion 7 is provided so that the detecting portion 7 can detect that the state of the developer collecting container 1 is close to the fully filled state, and therefore, the bonding portion 5 can be provided below the detecting portion 7 and can be provided below a height corresponding to half of the target collecting volume similarly as in Embodiment 1. In this embodiment, such an arrangement is employed.

Further, in this embodiment, at least a part of the bonding portion 5 is positioned immediately below the receiving opening 2. At this time, when the collected toner falling through the receiving opening 2 is deposited on an upper portion of the bonding portion 5, the powder surface of the collected toner becomes non-uniform, so that it would be considered that the non-uniform powder surface has the influence on the detection of the collected toner at the detecting portion 7. For that reason, a cross-sectional shape of the bonding portion 5 may preferably be an upwardly projecting shape. That is, a shape of the bonding portion 5 cut substantially parallel to the sides bonded by the bonding portion 5 may preferably be the upwardly projecting shape (shape such that a weight decreases with an increasing position toward above with respect to the direction of gravitation. By this, in the case where the powder is collected in the developer collecting container 1, accumulation of the powder on the bonding portion 5 is suppressed, so that a degree of deposition of the powder can be uniformly maintained.

FIG. 7 shows a side view and a partially cross-section (D-D line cross-section in the figure), of the developer collecting container 1, showing an example of the cross-sectional shape of the bonding portion 5. In this embodiment, the cross-sectional shape of the bonding portion 5 is a circular shape as shown in an upper-right view of FIG. 8. However, the shape is not limited thereto, but may also be a diamond shape as shown in a lower-right view of FIG. 8, for example. Thus, by making the cross-sectional shape of the bonding portion 5 the upwardly projecting shape, the deposition of the collected toner onto the upper portion of the bonding portion 5 is suppressed, so that the influence thereof on the powder surface of the collected toner can be suppressed.

Figure 8:
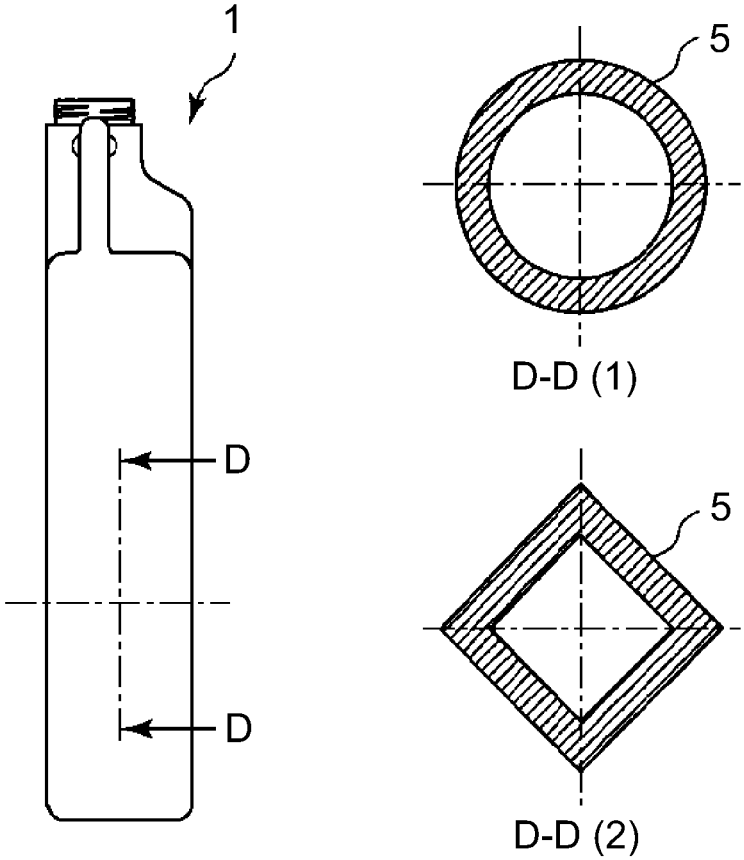
FIG. 8 is a side view and a partially sectional view, of the collecting container, showing an example of a cross-sectional of a connecting portion.

Incidentally, the cross-sectional shape of the bonding portion 5 in Embodiment 1 is also the circular shape as shown in the upper-right view of FIG. 8, but may also be the diamond shape as shown in the lower-right view of FIG. 8. Further, also, in this embodiment, similarly as in Embodiment 1, a single bonding portion 5 is provided at a substantially central portion of each of the front wall side 4*a* and the rear wall side 4*b* with respect to the horizontal direction, but a plurality of bonding portions 5 may also be provided as desired.

As described above, according to this embodiment, even in the case where the developer collecting container 1 is increased in volume, the deformation of the developer collecting container 1 can be suppressed by a constitution which is simple and advantageous in suppression of an increase in cost, so that a lowering in operativity during mounting and dismounting of the developer collecting container 1 and a lowering in detection accuracy of the collected toner can be suppressed.

[Others]

In the above, the present invention was described in accordance with the specific embodiments, but the present invention is not limited to the above-described embodiments.

In the above-described embodiments, the collecting container collects the transfer residual toner and the deterioration developer as the collected toner collected in the image forming apparatus, but the present invention is not limited thereto, and for example, the collecting container may also be collect either one of the transfer residual toner and the deteriorated developer.

Further, in Embodiment 2, as a type of detecting the collected matter in the collecting container, the optically detecting type was used, but the type is not limited thereto. For example, in a constitution in which a sensor is provided on an accommodating portion side of an apparatus main assembly and a detecting portion is provided on a collecting container side of the apparatus main assembly, it would be considered that a relative position between the accommodating portion and the collecting container has the influence on detection accuracy irrespective of the detecting type. Further, even in a type in which the collected matter in the collecting container is detected only by the detecting portion substantially provided in the collecting container, it would be considered that deformation of the collecting container has the influence on detection accuracy of the collected matter in the collecting container, for example, in the case where a relationship between a height of an uppermost portion of the collected matter and a volume of the collected matter changes. Accordingly, application of a constitution similar to the constitution of Embodiment 2 irrespective of the detecting type is effective.

Further, in the above-described embodiments, the collected matter was powder, but the collected matter may also be fluid such as a liquid. The present invention can be applied to any collect when the collecting container collects a collected matter collected in an apparatus and is mountable to and dismountable from an accommodating portion provided in an apparatus main assembly.

INDUSTRIAL APPLICABILITY

According to the present invention, there is provided a developer collecting container which is simple and which is capable of suppressing deformation even in the case where a volume of the developer collecting container is increased.

The invention claimed is:

1. A developer collecting container, mountable to and dismountable from an accommodating portion of an image forming apparatus for forming an image with developer, for collecting the developer, the developer collecting container comprising:

a receiving opening for receiving the developer;

a collecting portion configured to collect the developer, the collecting portion including a first side having a first side surface and a second side having a second surface, the first and second surfaces extending in directions that are substantially parallel to each other, with a length of the first side surface in the vertical direction being longer than the length of the first side surface in the horizontal direction;

a first recess portion provided in the first side, the first recess portion having a bonding portion at a bottom of the first recess portion, the bonding portion of the first recess portion extending in a direction that is substantially parallel to the direction of the first side surface;

a second recess portion provided in the second side, the second recess portion having a bonding portion at a bottom of the second recess portion, the bonding portion of the second recess portion extending in a direction that is substantially parallel to the direction of the second side surface, wherein the bonding portion of the first recess portion is bonded to the bonding portion of the second recess portion, and wherein the bonding portion of the first recess portion closes the bottom of the first recess portion and the bonding portion of the second recess portion closes the bottom of the second recess portion such that the first and second recess portions do not open to each other.

2. A developer collecting container according to claim 1, wherein the developer collecting container includes a third side having a third side surface adjacent to the first side and the second side, and the developer collecting container includes a fourth side having a fourth side surface adjacent to the first side and the second side and opposing the third side, the third and fourth surfaces extending in directions that are substantially parallel to each other.

3. A developer collecting container according to claim 2, wherein a width of the first side is greater than a width of the third side.

4. A developer collecting container according to claim 1, wherein a height from a bottom of the developer collecting container to the bonding portion is less than a height at which a volume of the accommodating portion is half of a target collecting volume.

5. A developer collecting container according to claim 1, further comprising a portion-to-be-detected for detecting the developer in the developer collecting container, wherein a height from a bottom of the developer collecting container to the bonding portion is lower than a height from the bottom of the developer collecting container to the portion-to-be-detected.

6. A developer collecting container according to claim 5, wherein the portion-to-be-detected is provided on the first side.

7. A developer collecting container according to claim 1, wherein the first side surface and the second side surface are formed integrally.

8. A developer collecting container according to claim 1, wherein the developer collecting container includes a bottom that is a mounting surface contacting the image forming apparatus when the developer collecting container is mounted in the image forming apparatus.

9. A developer collecting container according to claim 1, wherein the first side is greatest in surface area among sides forming the developer collecting container.

10. A developer collecting container according to claim 1, wherein a cross-sectional shape of the bonding portion as seen in a direction perpendicular to a wide direction of the first side is an upwardly projecting shape and a peak position of the bonding portion is in a range where the receiving opening is provided with respected to the wide direction of the first side.

11. A developer collecting container according to claim 1, wherein the first side surface is arranged along a mounting/dismounting direction of the developer collecting container, and the first side surface is configured to slide along an inner surface of the accommodating portion when the developer collecting container is mounted to or dismounted from the accommodating portion.

* * * * *